US005582329A

United States Patent [19]

Watson

[11] Patent Number: 5,582,329

[45] Date of Patent: Dec. 10, 1996

[54] BOTTLE WITH DISPENSING VALVE WHICH IS FITTABLE TO THE BOTTLE IN BOTH A USE AND A STORAGE POSITION

[76] Inventor: John Watson, 4605 Donegal Dr. Unit #17, Mississauga, Ontario, Canada, L5M 4X7

[21] Appl. No.: 335,375

[22] Filed: Nov. 3, 1994

[30] Foreign Application Priority Data

Oct. 21, 1994 [CA] Canada ..... 2134022

[51] Int. Cl.[6] ..... B67D 5/06

[52] U.S. Cl. ..... 222/108; 222/539

[58] Field of Search ..... 222/108, 153.09, 222/153.10, 182, 143, 530, 539, 540, 465.1, 518, 568, 571, 559

[56] References Cited

U.S. PATENT DOCUMENTS

| | | | |
|---|---|---|---|
| 1,938,479 | 12/1933 | Baker, Jr. | 222/539 |
| 2,597,593 | 5/1952 | Neuner | 222/540 |
| 4,241,856 | 12/1980 | Otterson | 222/539 |
| 4,572,386 | 2/1986 | Marcus | 222/539 |
| 5,020,702 | 6/1991 | James | 222/568 |

FOREIGN PATENT DOCUMENTS

| | | | |
|---|---|---|---|
| 2061647 | 8/1993 | Canada | 222/539 |
| 148592 | 8/1920 | United Kingdom | 222/530 |

*Primary Examiner*—Andres Kashnikow
*Assistant Examiner*—Philippe Derakshani

[57] ABSTRACT

A bottle has a dispensing valve which is held internally of the bottle when in a storage position. The valve is fitted within a container that prevents the liquid contents in the bottle from splashing up onto the valve. The valve is removable from the container and the container may be discarded when the valve is moved from the storage to the in-use position.

2 Claims, 4 Drawing Sheets

BOTTLE WITH DISPENSING VALVE WHICH IS FITTABLE TO THE BOTTLE IN BOTH A USE AND A STORAGE POSITION

FIELD OF THE INVENTION

The present invention relates to a bottle with its own dispensing valve where the valve is contained within the bottle when in the storage position. A splash guard is provided to prevent the contents of the bottle from splashing on to the stored dispenser.

BACKGROUND OF THE INVENTION

According to conventional design, liquid containers of the dispensing type are generally provided with permanent dispensers located along one face of the container. This makes the container difficult and awkward to both store and ship because of the exposed position of the valve.

It is known to make containers with closure caps having a pouring spout or funnel that can be stored at the cap extending inwardly of the container in a non-use position. The cap includes an additional sealing member which is removed and the funnel is reversed to an open in-use position. This type of container, such as for example a gasoline storage bottle, does not include anything in the way of an automatic sealing dispensing valve. Furthermore, the funnel is constantly exposed to the liquid contents in the bottle which can accumulate on and possibly eventually block or even damage the funnel. When the funnel is in the in-use position, this is not a problem because the liquid is able to drain away from the funnel back down into the bottle.

SUMMARY OF THE INVENTION

The present invention provides a bottle with a dispenser which is held within the bottle when the dispenser is in the storage position. The dispenser itself is fitted within a container which blocks the dispenser from the contents of the bottle so that there is no build up or other type of damage caused to the dispenser when it is being stored. The dispenser is removable from the container which can then be discarded when the dispenser is moved to the in-use position on the bottle.

BRIEF DESCRIPTION OF THE DRAWINGS

The above as well as other advantages and features of the present invention will be described in greater detail according to the preferred embodiments of the present invention is which.

DETAILED DESCRIPTION ACCORDING TO THE PREFERRED EMBODIMENTS

Figure 1:
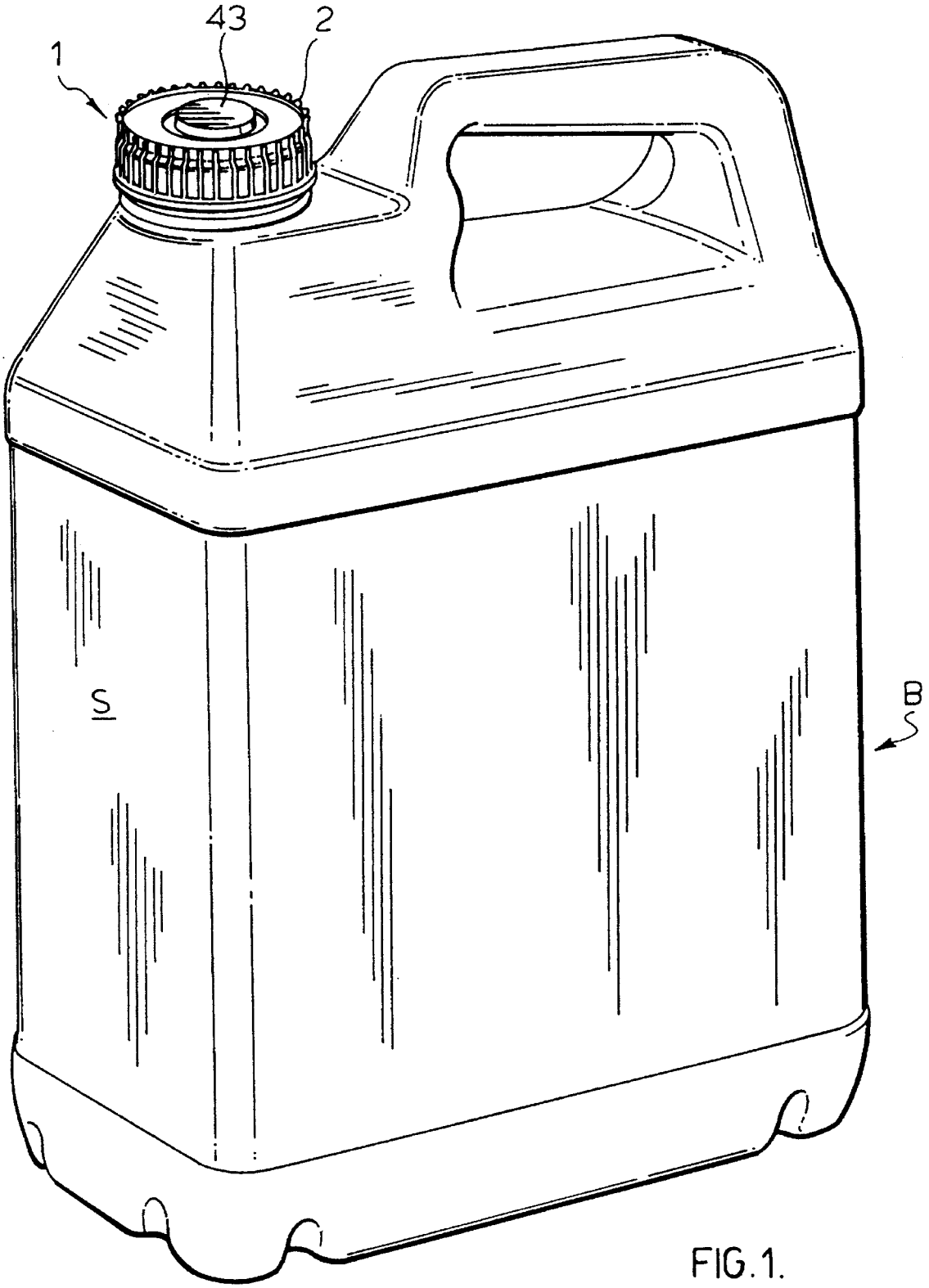
FIG. 1 is a perspective view of a liquid containing bottle with a closure and dispensing valve arrangement in the storage position according to a preferred embodiment of the present invention.
Figure 3:
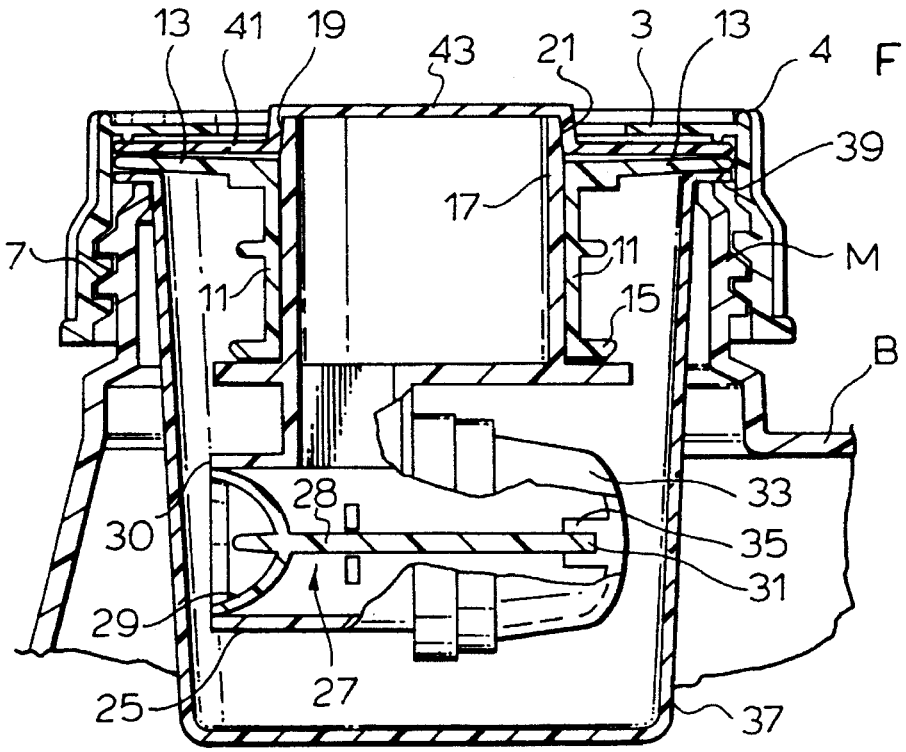
FIG. 3 is a sectional view through the mouth area of the bottle of FIG. 1.
Figure 4:
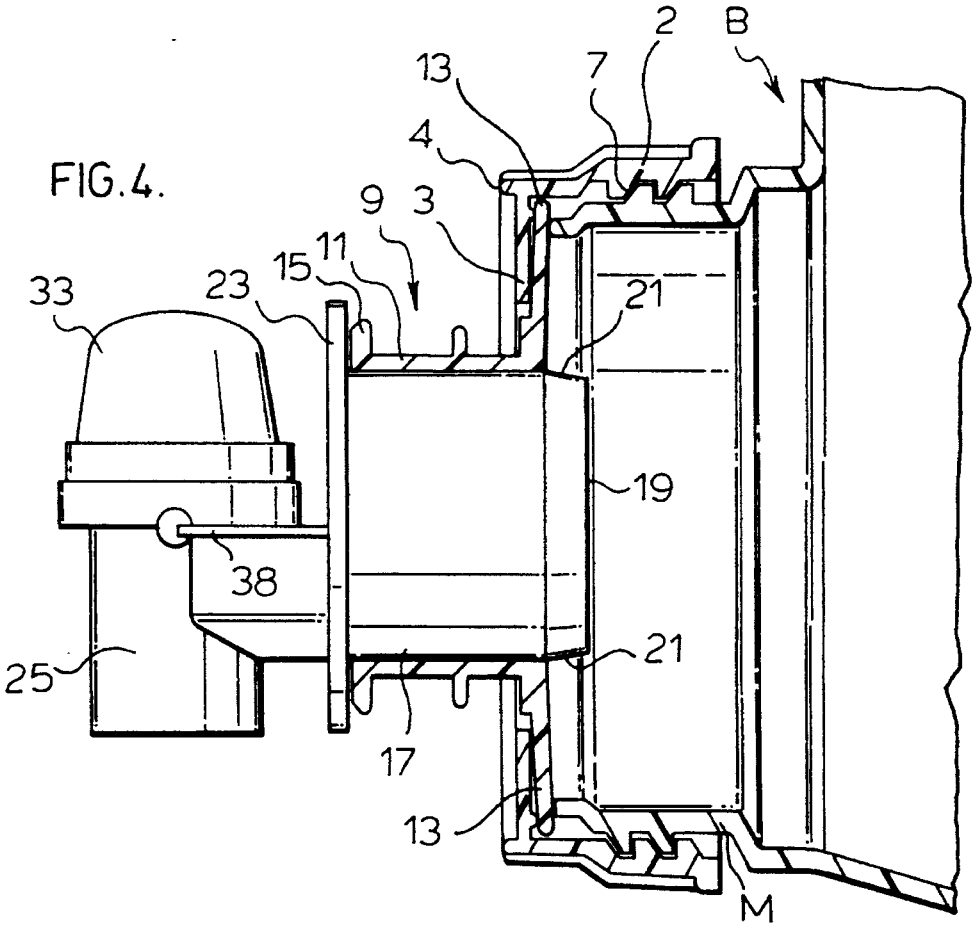
FIG. 4 is a side view of the closure and dispensing valve arrangement fitted to the bottle mouth and reversed from the storage to the use position.
Figure 5:
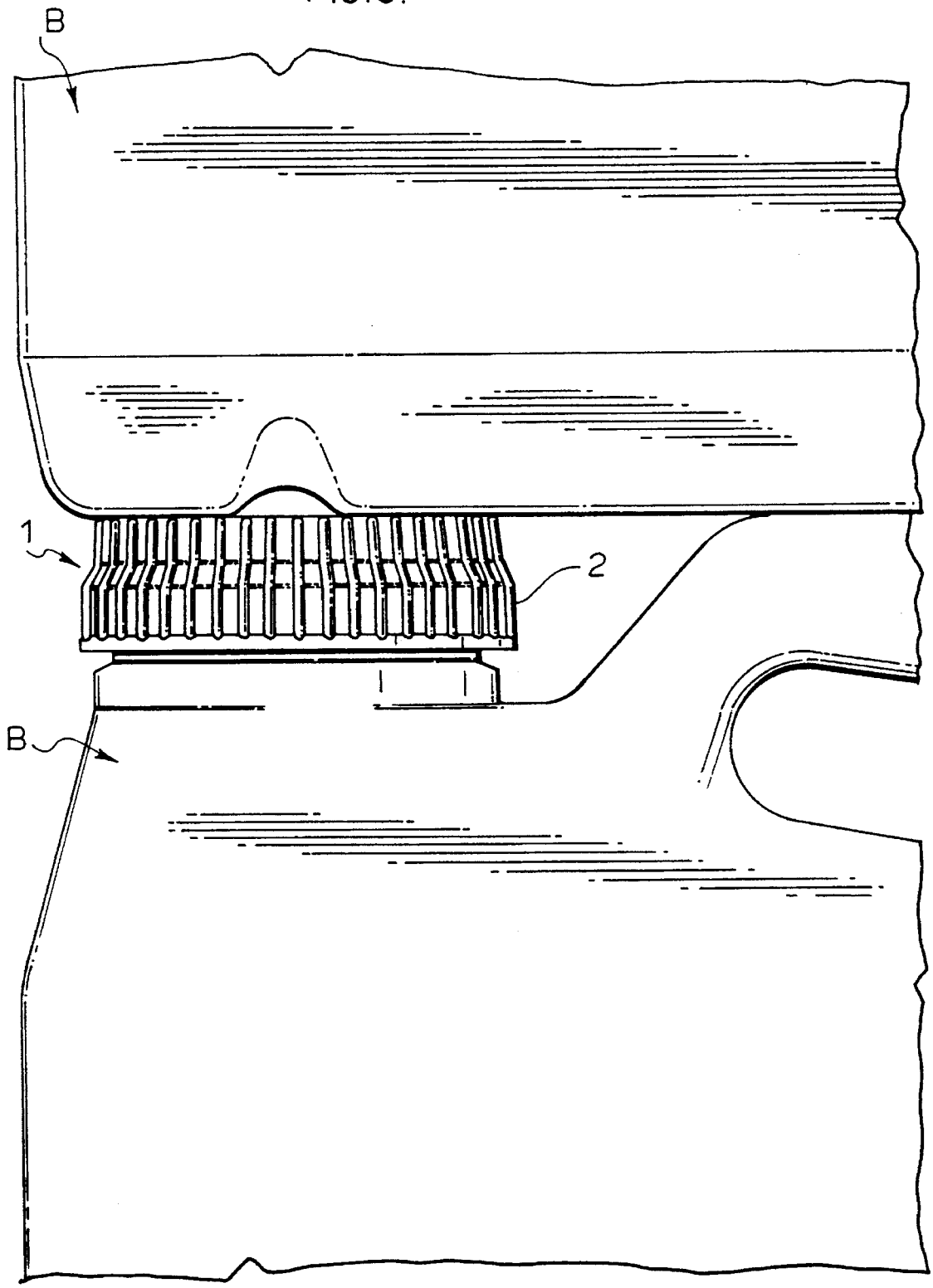
FIG. 5 is a side view of the container of FIG. 1 stacked with a further container.

FIG. 1 shows a container or bottle generally indicated at B. This bottle includes a threaded mouth M, best seen in FIG. 2 of the drawings. The closure cap and dispensing valve arrangement generally indicated at 1 is fitted to the mouth of the bottle. As earlier noted, FIGS. 1, 2 and 3 show the closure cap with a dispensing valve in a storage position whereas FIG. 4 shows the closure cap with the dispensing valve in a use position.

Figure 2:
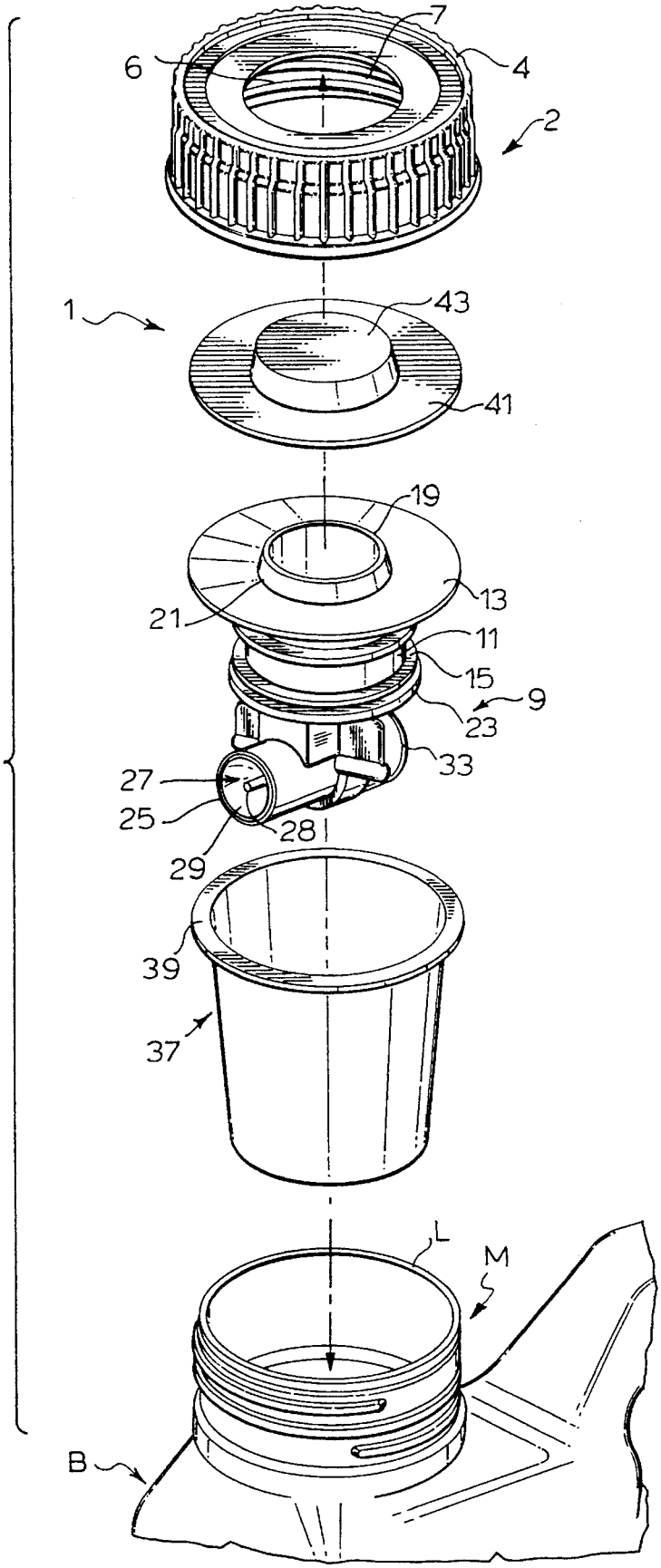
FIG. 2 is an enlarged exploded perspective view of the bottle mouth and stored dispensing valve arrangement of FIG. 1.

Referring to FIG. 2, the overall arrangement includes a cap 2 which has a center opening 6 and a threaded interior 7. For reasons that will be described later in detail, the closure cap includes a raised lip 4 around its upper edge.

Also provided in the overall arrangement is a spigot generally indicated at 9. This particular portion of the arrangement is referred to as a spigot since it is used to close the center opening 6 in the closure cap in both the storage and the use position.

Spigot 9 comprises a main axially extending hollow body 11 having a large radially extending lip 13 at one end and a smaller radially extending lip 15 at its other end. Trapped within hollow body 11 is a dispenser body 17 which has a tapered end 19 and an undercut wedge shaped base 21. The other end of the dispenser body includes a radially extending lip 23. This is well shown in FIG. 4 of the drawings.

The dispenser body 17 is secured within hollow body 11 as a result of the interlock between undercut base 21 on the dispenser body and radial lip 13 on the hollow body 11 at the one end of the set up and at the other end of the set up due to the edge to edge contact of radial lip 15 on body 11 and radial lip 23 on body 17. The inward tapering of end 19 on body 17 eases its insertion within hollow body 11 to the interlocking position as shown.

The dispenser body further comprises valve housing 25 having a hollow interior to define a dispensing opening from the dispenser body. Trapped within the housing portion 25 is a movable valve, generally indicated at 27 and comprising an axially extending stem 28 having a cup shaped sealing portion 29 at one end. The other end 31 of stem 28 is secured to a valve retractor in the form of a rubber cap 33 having an interior grommet 35 for receiving and holding the end 31 of stem 28.

In the FIGS. 2 and 3 storage position, spigot 9 is located such that the dispensing valve is trapped beneath cap 2. The dispensing valve itself is contained within a splash guard cup generally indicated at 37. This splash guard cup includes a radially extending rim 39 on which the radial lip 13 of the spigot is seated. A cup top 41 with raised central portion 43 fits over the end 19 of the spigot so that the spigot is fully contained within the cup 37 and its cover 41. The raised region 43 on the cover 41 fits up through the center opening 6 on the closure cap 2 and can be used as a surface on which to provide instructions for use of the dispensing valve. For reasons to be described later, raised region 43 on the top 41 extends no higher than the raised edge 4 around the cap 2.

The lip 39 of cup 37 seats on the lip L of the bottle mouth M but does not extend radially outwardly of the bottle mouth. This allows the cap 2 to be threaded down onto the bottle mouth over both the cup and the spigot contained in the cup. As shown in FIG. 3 of the drawings, the spigot is now fully contained within the cup covered from both below and above by the cup. The top cover ensures that the intake end of the spigot which faces upwardly in the storage position remains clean and free of any dirt or the like which would otherwise collect on the spigot through the cap opening 6. The cap provides a locking device for holding the cup with the contained spigot internally of the bottle.

As earlier noted, the raised region 43 on the cup top 41 fits through the center opening 6 of the cap 2. This provides a center locator between the spigot and the cap. Furthermore, because the raised region 43 does not extend upwardly beyond the raised edge 4 of the cap, any bottle sitting atop the closure in the storage position seats on the lip of the cap and not on the covered end of the spigot which would apply downward pressure attempting to force the spigot and the cup-like container down into the bottle.

In order to move the spigot to the dispensing position of FIG. 4, the cap is simply released from the bottle mouth. The spigot is taken out of the container-like cup which can then be either discarded or saved for further storage useage. The main body of the container is also usable as a measuring cup into which liquid can be dispensed from the spigot. The spigot is reversed in position so that the dispensing end of the spigot fits upwardly through the cap in the opposite direction to its storage position. When the spigot is in the use position, radial lip 13 of the spigot fits against the underside of the top wall of the cap and is trapped between the cap and the lip L of the bottle mouth M. As will be appreciated from the above, the opening 6 through the cap is sufficiently wide to allow fitting of the dispenser end of the spigot upwardly through the cap. The radial lip 13 is sufficiently large and rigid to be firmly trapped between the bottle mouth and the cap top wall and provides a seal against leakage of any liquid trapped in the bottle past the cap.

As earlier noted valve 27 normally assumes a sealing position in the dispensing opening of the valve housing. This feature is caused as a result of the connection between the valve stem 28 and rubber cap 33. The cap as best seen in FIGS. 2 and 3 of the drawings because of its rubber construction and the memory of the rubber always wants to assume its molded form in which the cap pulls the valve end 29 into a sealing position indicated at 30 at the dispensing opening. However, the rubber cap can be pushed inwardly under pressure which causes the valve to move forwardly and drives valve end 29 outwardly of housing portion 25 thereby opening the dispenser. As soon as the pressure is released cap 33 then pulls the valve back to its sealing position. This arrangement while being extremely efficient is also very simple and does not rely on complicated parts which are subject to wear and premature breakdown. The rubber cap itself has an extremely long life and should it fail, it can easily be replaced by simply pulling the valve stem out of the cap, removing the cap from the valve housing and replacing it with a new cap ready to receive the old valve stem.

In order to dispense liquid from the bottle, it is set up in its side surface S which is made flat as shown in FIG. 1 of the drawings. The closure and dispensing valve arrangement is positioned such that the dispensing opening faces downwardly. This set up is easily arrived at since spigot 9 is rotational within closure cap 2 and can be held with the dispensing opening in the down position while the closure cap is tightened to the bottle mouth.

In order to dispense the contents of the bottle, pressure is applied on cap 33 to open valve 27. A pair of finger grips 38 are provided so that the thumb can be used to press on the cap while holding the finger grips 38 with the forefinger and the middle finger of the same hand. The liquid inside the bottle will drain out as long as the valve is held open and as soon as the pressure is released on cap 33, it pulls the valve back to its sealing position to close the dispenser.

It has been found that generally speaking, the interior pressure within the bottle is sufficient to assist in the dispensing of the bottles contents. However, if necessary, a small hole or some other type of venting means may be provided in the bottle to provide pressure in forcing the liquid out when the dispenser valve is opened.

In the preferred form, both closure cap 2 and spigot 9 have an all plastic construction. The particular plastic material used is one which is durable and easily cleaned. The only deviation from the plastic construction is, as noted above at cap 33, where the resilient rubber is important for allowing opening and producing closing of the dispensing valve.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property of privilege is claimed are defined as follows:

1. A bottle with a dispensing valve which is fittable to the bottle in both a use and a storage position, said valve being held internally of said bottle when in the storage position and being fitted within a two piece cup which blocks said dispensing valve from any liquid contents of said bottle, said bottle having a closure cap which locks both said dispensing valve and said cup within said bottle in the storage position, said two piece cup being removable from said bottle when said dispensing valve is moved to the use position and said two piece cup comprising a main cup body with a removable top, said closure cap having a dispensing opening, said top of said cup blocking said dispensing opening while covering said valve.

2. A bottle as claimed in claim 1, wherein said main cup body comprises a measuring cup.

* * * * *